US006648714B1

(12) United States Patent
Kuo et al.

(10) Patent No.: US 6,648,714 B1
(45) Date of Patent: Nov. 18, 2003

(54) TOY BRICK

(75) Inventors: His-Chian Kuo, No. 69, Lane 679, Sec. 2, Jungjeng Rd., Rende Shiang, Tainan (TW); Shih-Jung Cheng, Tainan (TW)

(73) Assignee: His-Chian Kuo, Tainan (TW)

( * ) Notice: Subject to any disclaimer, the term of this patent is extended or adjusted under 35 U.S.C. 154(b) by 0 days.

(21) Appl. No.: 10/403,289

(22) Filed: Apr. 1, 2003

(51) Int. Cl.[7] ..... A63H 33/04
(52) U.S. Cl. ..... 446/85; 446/120
(58) Field of Search ..... 446/85, 117, 119, 446/120, 121, 122, 124, 125; 273/156, 157 R

(56) References Cited

U.S. PATENT DOCUMENTS 4,932,916 A * 6/1990 Blickle ..... 446/124
5,238,231 A * 8/1993 Huang ..... 267/35
5,848,927 A * 12/1998 Frederiksen ..... 446/128

* cited by examiner

*Primary Examiner*—Jacob K. Ackun
*Assistant Examiner*—Jamila Williams
(74) *Attorney, Agent, or Firm*—Rosenberg, Klein & Lee

(57) ABSTRACT

A toy brick includes a plastic main body, and a soft and elastic subsidiary part different color from the main body; the main body has a middle connecting through channel, first holding trenches on a front side thereof, and second holding trenches formed on surfaces of comers located between every adjacent two of upper, lower, left, and rear sides thereof; the subsidiary part has a middle sleeve portion closely fitted in the connecting channel of the main body, first covering portions adhered to corresponding ones of the first holding trenches of the main body, and second covering portions adhered to corresponding ones of the second holding trenches; thus, toy bricks of the kind will produce less noise when hitting each other or the floor, and are less hard at the corners.

7 Claims, 6 Drawing Sheets

TOY BRICK

BACKGROUND OF THE INVENTION

1. Field of the Invention

The present invention relates to a toy brick, more particularly one, which is formed of relatively soft substance on the edges and the front ends to be safe to use and easy to hold and not produce loud noise when it hits other objects or other toy bricks of the kind.

2. Brief Description of the Prior Art

Toy bricks are very popular toys for small children because virtually infinite variety of combinations can be built from toy bricks, helping children develop their imagination and creativity, while common toy bricks are affordable.

A kind of toy brick set includes toy bricks, each of which has an insertion portion on one side, and connecting holes on other sides, so that the toy bricks can be built into various firm combinations by means of inserting insertion portions into connecting holes of other ones. However, there will be difference between the real size of an insertion portion of a toy brick and the design, and between the real size of a connecting hole and the design due to shrinkage of the materials in manufacturing, which might cause connection between toy bricks to become either too difficult or too loose.

Most toy bricks are made of wood or plastics that are very hard. A toy brick is likely to have small sharp residuals of materials on the edges when it is just taken out a mold thereof, in which it is formed by means of injection molding; these small sharp residuals of materials on the edges have to be thoroughly removed, otherwise they are prone to make people feel painful, and even get injured, if people accidentally step on or rub against the toy brick. Even though small sharp residuals of materials on edges of a toy brick have been removed, the toy brick is still likely to make people feel painful when people accidentally step on or rub against it if it is very hard.

Most toy bricks are made in single part, and in turns, they are single color, and look very monotonous and lack attractiveness.

SUMMARY OF THE INVENTION

It is a main object of the present invention to provide a toy brick, which includes a plastic main body, and a soft and elastic subsidiary part, which can be joined to the main body easily and securely; some portions of the soft and elastic subsidiary part are adhered to the comers of the main part. An insertion portion of the soft and elastic subsidiary part is used for connection with a second toy brick of the kind therefore toy bricks of the present invention can be relatively firmly connected to each other.

Toy bricks of this kind will not produce loud or annoying noise when hitting each other or the floor under the game of construction, and are less likely to cause people to get injured or feel painful if people step on or rub against the bricks accidentally because the subsidiary parts thereof are made of soft and elastic materials.

It is another object of the present invention to make the main body and the subsidiary part of the toy brick different colors so that the toy brick is more attractive.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
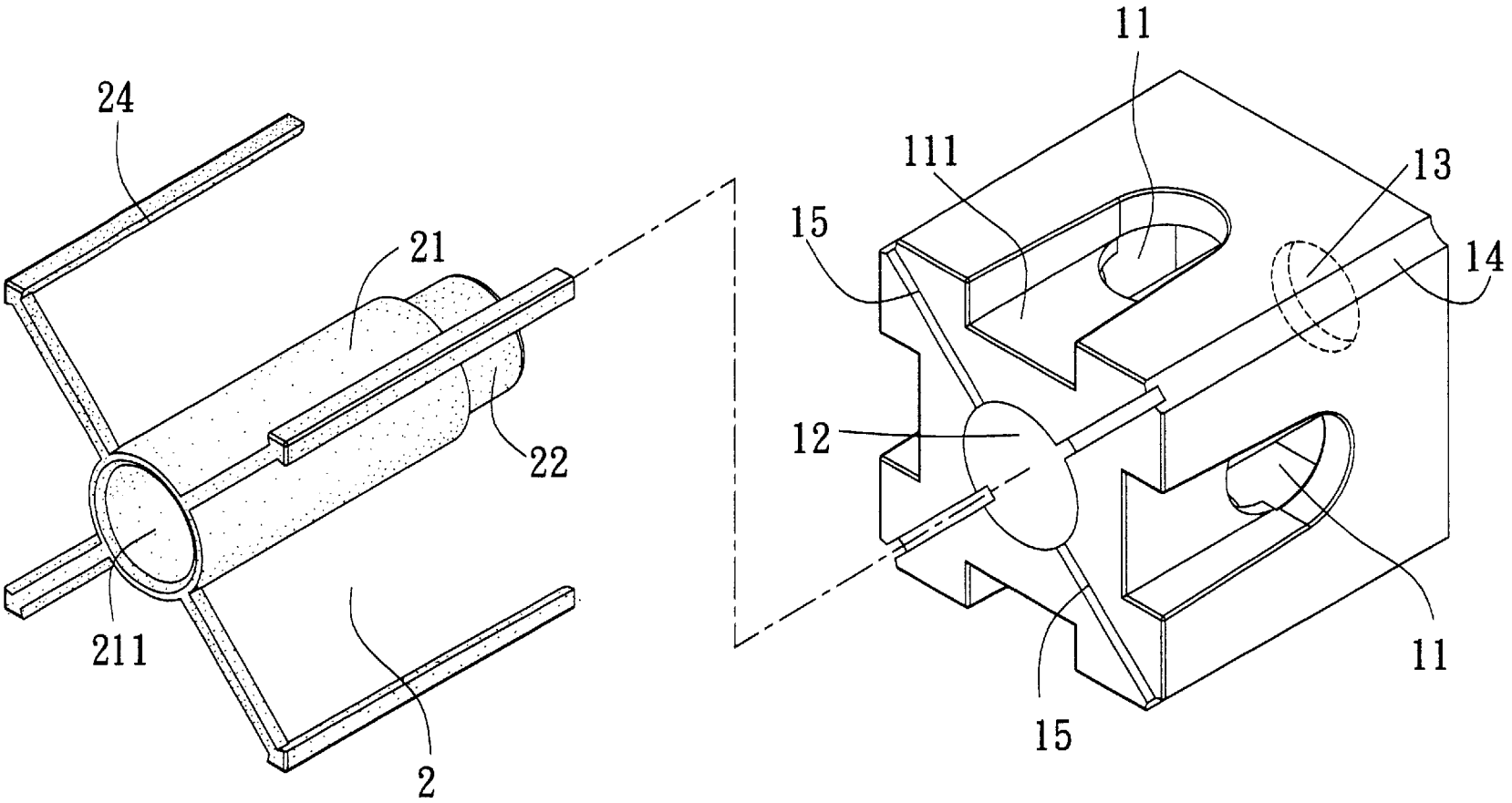
FIG. 1 is an exploded perspective view of the toy brick according to IS the present invention.

Referring to FIG. 1, a preferred embodiment of a toy brick in the present invention includes a main body 1, and a subsidiary part 2.

The main body 1 is made of plastic material and by means of injection molding. The main body 1 has four connecting holes 11 on an upper side, a lower side, a left side, and a right side thereof respectively, and has a connecting channel 12 extending from a middle of a front side to a rear side thereof. The connecting channel 12 includes a front channel portion, and a tail channel portion 13, which is smaller than the front channel portion in diameter. Guide trenches 111 are provided on the main body 1 for allowing the main body 1 to be easily moved out of the mold thereof in the direction along the guide trenches 111; the guide trenches 111 are formed on the upper side, the lower side, the left side, and the right side of the main body 1 respectively, i.e. between every adjacent two of the upper, lower, left, and rear sides, and extend from corresponding ones of the connecting holes 11 to the front side of the main body 1.

The main body 1 is formed with holding trenches 14 on comers located between the upper side and the left side, between the upper side and the right side, the lower side and the left side, and the lower side and the right side thereof; all of the holding trenches 14 extend from the front side to the rear side of the main body 1. The main body 1 is further formed with holding trenches 15 on the front side thereof, which extend from the corners of the front side to the connecting channel 12, and are directed to the central axis of the connecting channel 12.

The subsidiary part 2 is made of relatively soft and elastic materials such as rubber. The subsidiary part 2 has a middle sleeve portion 21 shaped so as to be capable of fitting in the connecting channel 12 of the main body 1, four first covering portions 23 extending vertical to the sleeve portion 21 from the front end of the sleeve portion 21 in radial pattern, and four second covering portions 24 extending, parallel to the sleeve portion 21, from outward ends of corresponding ones of the covering portions 23. The subsidiary part 2 further has an insertion portion 22, which extends from a rear end of the sleeve portion 21, and which is shaped so as to be capable of closely fitting in the connecting channel tail portion 13; the insertion portion 22 is longer than the channel tail portion 13 so that it can project from the rear side of the main body 1 when the sleeve portion 21 is inserted into the connecting channel 12. The sleeve portion 21 has a connecting room 211, of which the diameter is substantially equal to the outer diameter of the insertion portion 22.

Figure 3:
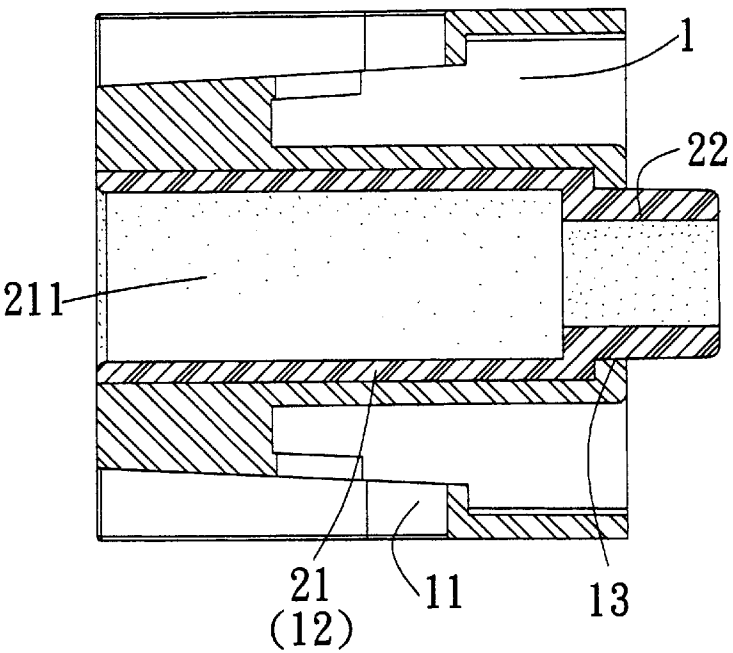
FIG. 3 is a cross-sectional view of the toy brick according to the present invention.
Figure 2:
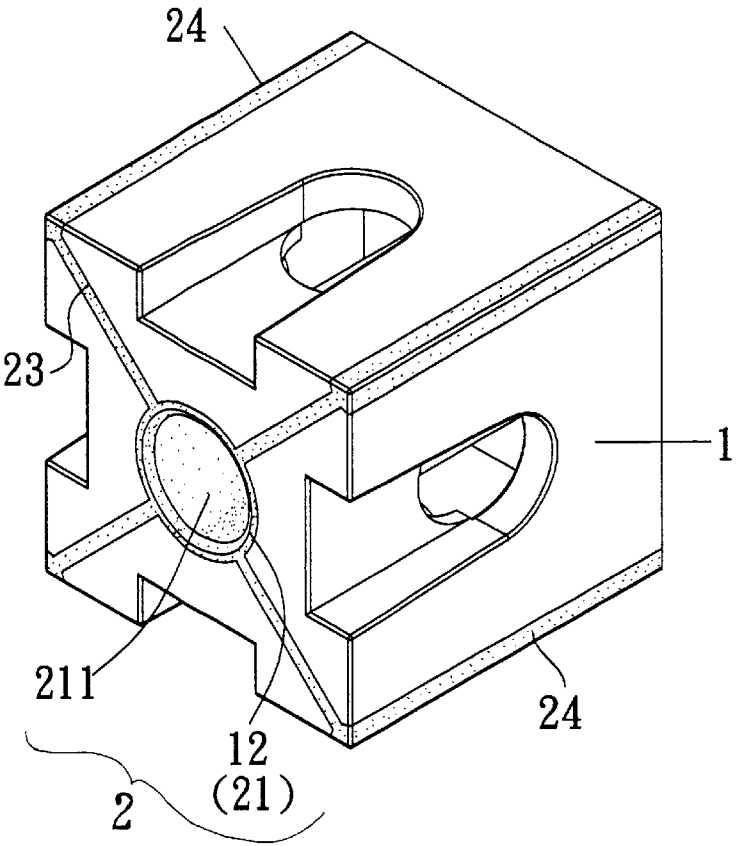
FIG. 2 is a perspective view of the toy brick according to the present invention.

Referring to FIGS. 2, and 3, in assembly, the sleeve portion 21 is tightly inserted into the connecting channel 12, and the insertion portion 22 joined to the channel tail portion 13, and the first covering portions 23 are fitted in, and adhered to, corresponding ones of the holding trenches 15, and the second covering portions 24 are fitted in, and adhered to, corresponding ones of the holding trenches 14. Thus, the front side and four corners located between adjacent ones of the upper, lower, left, and right sides of the main body 1 are provided with objects, e.g. rubber in the present embodiment, that are relatively soft as compared with the main body 1.

Figure 4:
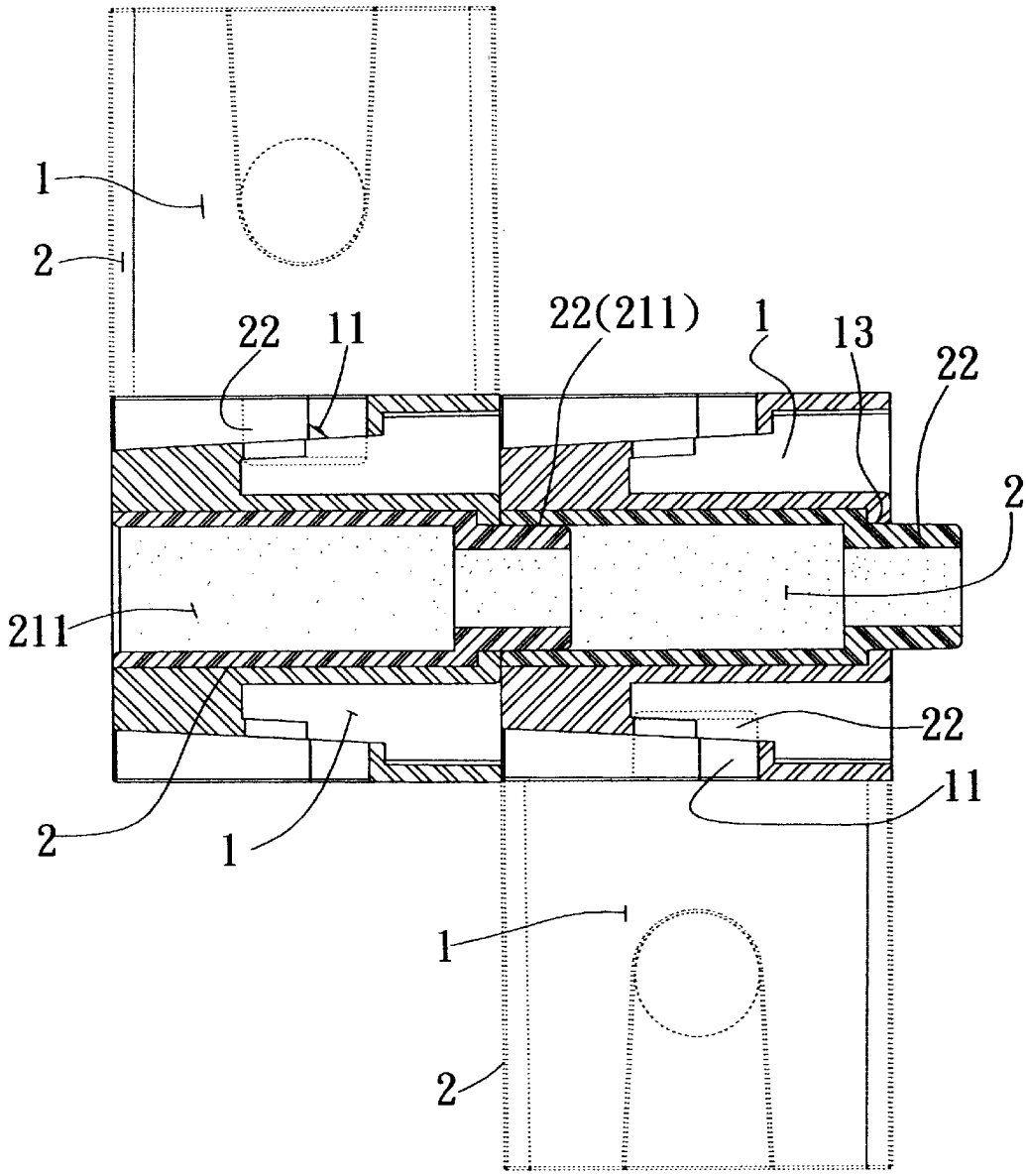
FIG. 4 is a view of four toy bricks of the kind joined together according to the present invention.

In playing with toy bricks of the kind, referring to FIG. 4, an insertion portion 22 of a toy brick can be inserted into connecting rooms 211 or connecting holes 11 of other toy bricks to build infinite variety of combinations of toy bricks.

Because the subsidiary part 2 and the main body 1 are made of different materials separately, and joined together after each is made, subsidiary parts 2 and main bodies 1 can be made various colors so that toy bricks of the kind can be each made with a big variety of combinations of colors to be more attractive, especially when they are joined together. Furthermore, because the subsidiary part 2 is relatively soft and has elasticity, the sleeve portion 21 can be tightly but easily inserted into the connecting channel 12 of the main body 1 in spite of shrinkage of the materials of the parts 1, and 2 in manufacturing, which will more or less cause difference between the size of the products 1, 2 and the design. For the same reason, toy bricks of the kind can be easily joined to each other with such firmness as to not unwantedly become separate.

Figure 5:
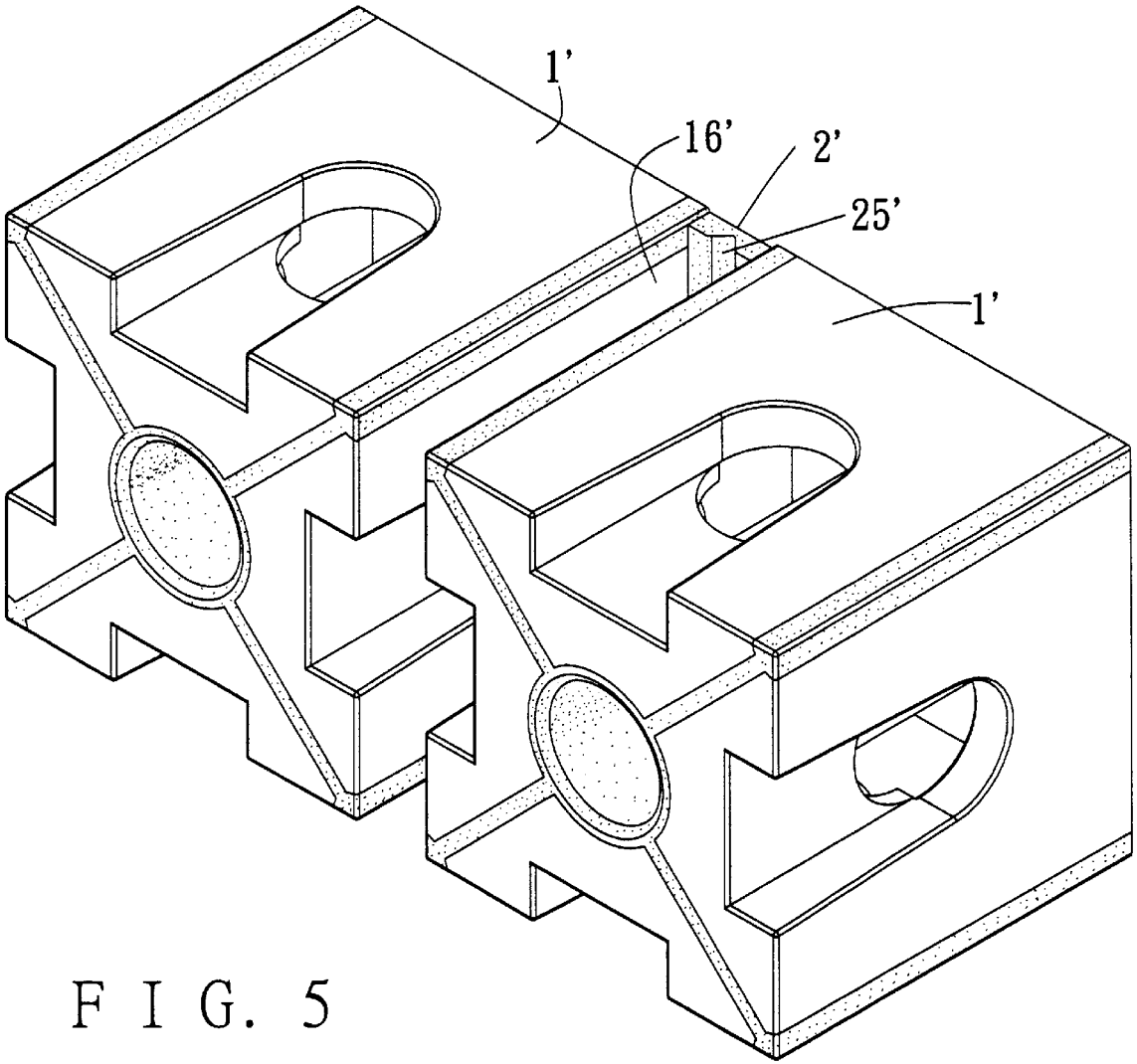
FIG. 5 is a perspective view of the toy brick of the second embodiment.
Figure 6:
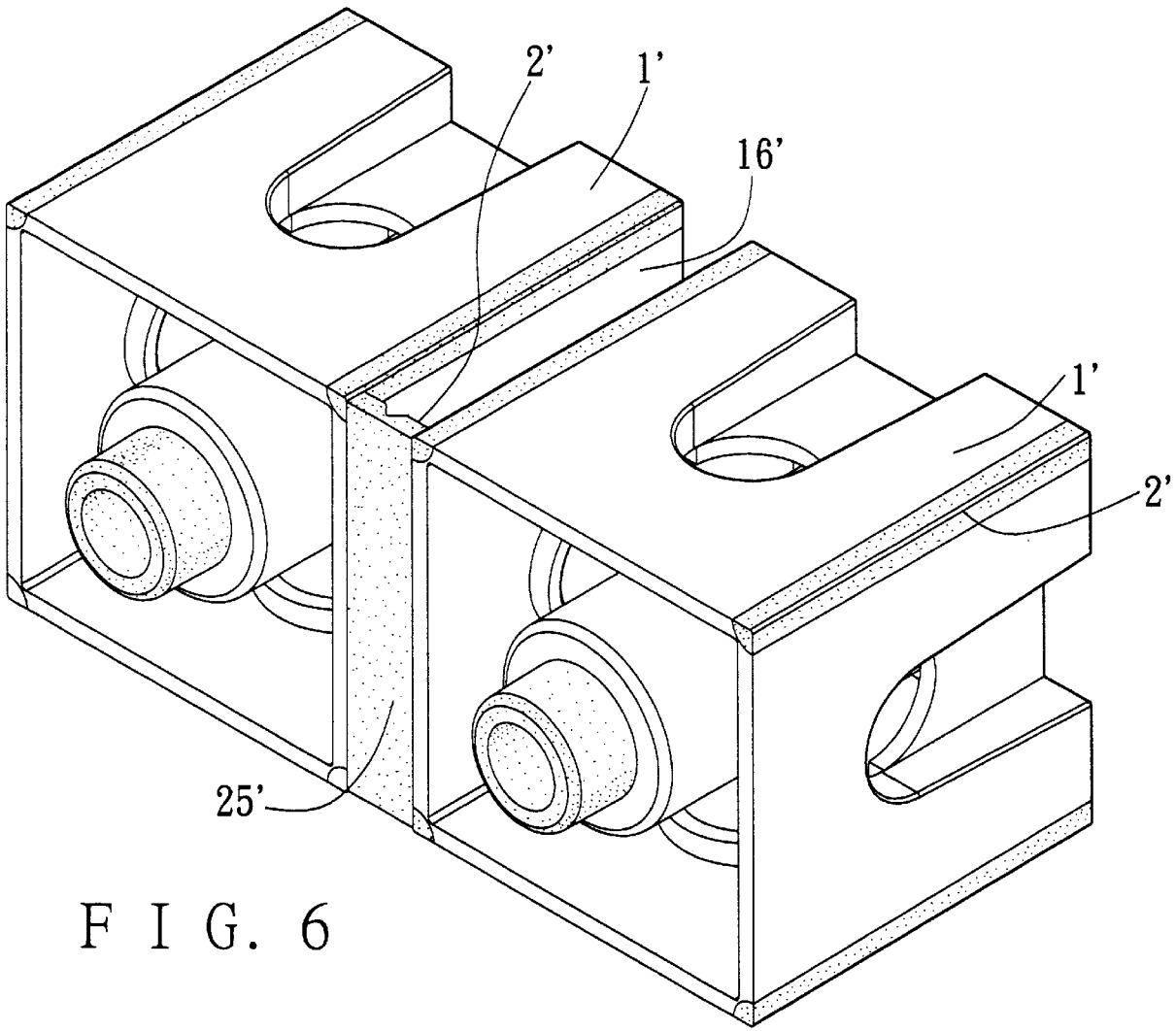
FIG. 6 is a rear view of the toy brick of the second embodiment.
Figure 7:
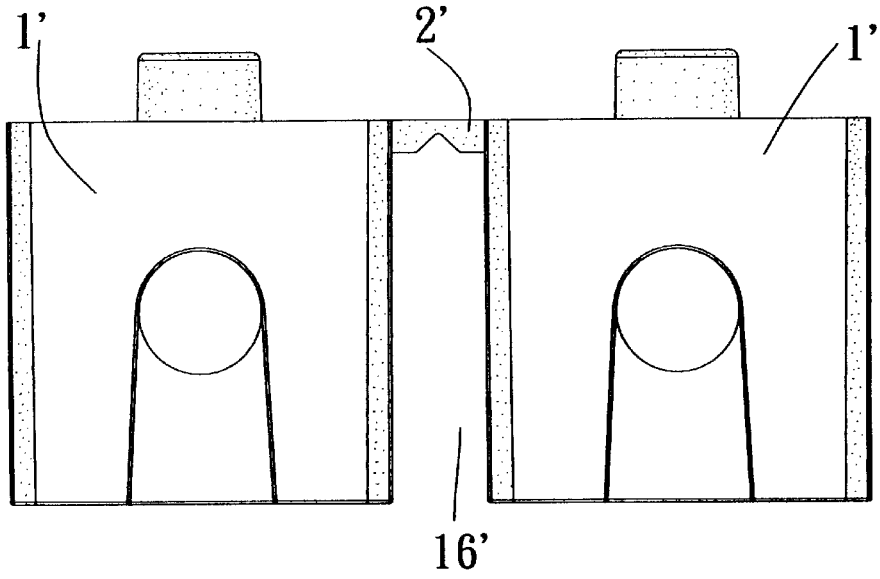
FIG. 7 is a vertical view of the toy brick of the second embodiment.
Figure 8:
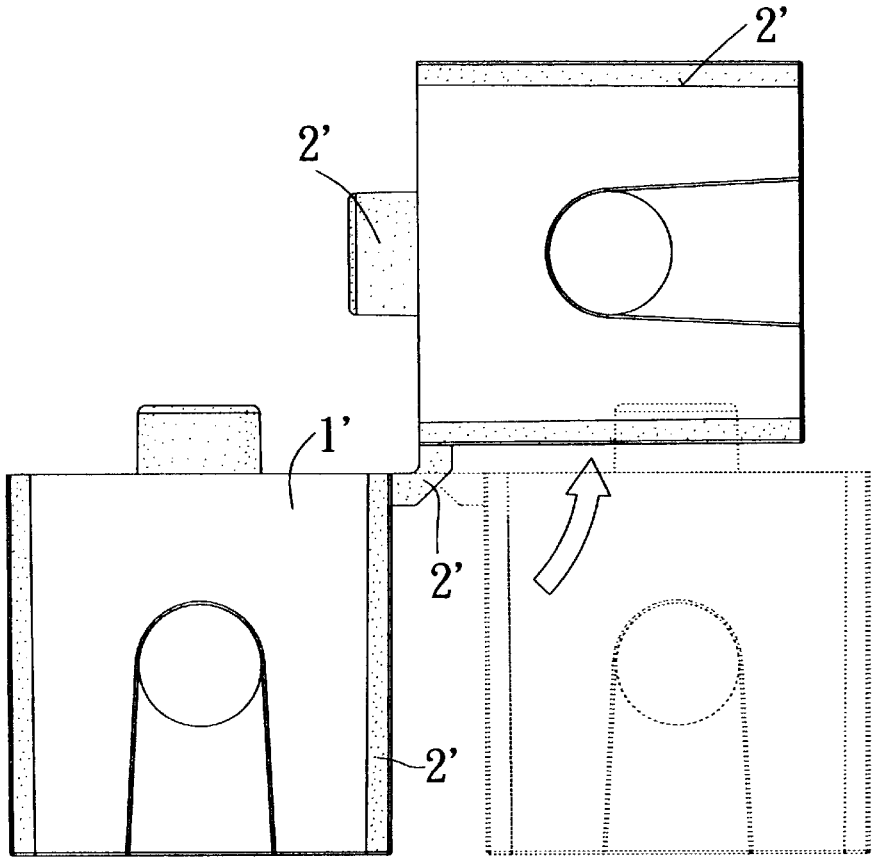
FIG. 8 is a vertical view of the toy brick of the second embodiment adapted for use.

Referring to FIGS. 5 to 6, a toy brick according to the second embodiment is comprised of two toy bricks of above mentioned kind joined together, each of which has a main body 1', and a subsidiary part 2', by means of a resilient extension part 25', which is located between, and connected to, rear ends of two opposing sides of the toy bricks. Referring to FIG. 7, when no external force is applied on the toy brick of the second embodiment, the toy brick is usually in a normal position, in which the opposing sides of the main bodies 1', 1' are parallel to each other with a space 16' in between. And, the toy brick of the second embodiment can be adapted for connection with other toy bricks of the first kind and the second kind by means of bending the resilient extension part 25' to change the position of the main bodies 1', 1'. Thus, a user can build infinite variety of combinations with toy bricks of both the first kind and the second kind.

From the above description, it can be easily understood that the toy bricks of the present invention has, besides what have been earlier mentioned, an advantage that they will not produce loud or annoying noise when hitting each other or the floor under the construction game, and are less likely to cause people to get injured or feel painful if people step on or rub against the bricks accidentally because the subsidiary parts 2, 2' are very soft and elastic.

What is claimed is:

1. An improvement on a toy brick, comprising a main body made of plastic material; the main body having a middle connecting channel extending from a front side to a rear side thereof; the main body being formed with first holding trenches on a front side thereof, which extend from corners of the front side to the connecting channel; the main body being formed with second holding trenches along surfaces of corners located between every adjacent two of upper, lower, left, and rear sides thereof; and a subsidiary part made of soft and elastic material; the subsidiary part having a middle sleeve portion closely fitted in the connecting channel of the main body; the subsidiary part having four first covering portions extending vertical to the sleeve portion from a front end of the sleeve portion and adhered to corresponding ones of the first holding trenches of the main body; the subsidiary part having four second covering portions extending rearwards from outward ends of the first covering portions and adhered to corresponding ones of the second holding trenches of the main body.

2. The improvement on a toy brick as claimed in claim 1, wherein an insertion portion extends from a rear end of the sleeve portion to project out from a rear side of the main body, and the main body has four connecting holes on an upper side, a lower side, a left side, and a right side thereof respectively; an outer diameter of the insertion portion being substantially equal to an inner diameter of the sleeve portion, and substantially equal to a diameter of the connecting holes of the main body.

3. The improvement on a toy brick as claimed in claim 2, wherein the connecting channel of the main body includes a front portion, and a tail channel portion, which is formed with such a diameter so as to allow the insertion portion of the subsidiary part to be closely fitted in.

4. The improvement on a toy brick as claimed in claim 1, wherein guide trenches are formed on the upper, lower; left, and right sides of the main body respectively, and extend from corresponding ones of the connecting holes to the front side of the main body for allowing the main body to be easily moved out of a mold thereof in a direction along the guide trenches.

5. The improvement on a toy brick as claimed in claim 1, wherein the material of the subsidiary part is rubber.

6. The improvement on a toy brick as claimed in claim 1, wherein the main body and the subsidiary part are made different colors.

7. The improvement on a toy brick as claimed in claim 1 being further joined to a second toy brick of a kind by means of a resilient extension part, which is located between, and connected to, rear ends of two opposing sides of the toy bricks.

* * * * *